US008704453B2

(12) United States Patent
Lin et al.

(10) Patent No.: US 8,704,453 B2
(45) Date of Patent: Apr. 22, 2014

(54) DRIVING CIRCUIT AND LIGHTING EQUIPMENT USING THE SAME

(75) Inventors: Huang-Ti Lin, Hsin-Chu (TW); Wen-Ti Chang, Hsin-Chu (TW); Yun-Sheng Chou, Hsin-Chu (TW); Yu-Hsiang Huang, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 447 days.

(21) Appl. No.: 13/219,079

(22) Filed: Aug. 26, 2011

(65) Prior Publication Data

US 2012/0161664 A1 Jun. 28, 2012

(30) Foreign Application Priority Data

Dec. 27, 2010 (TW) ..... 99146162 A

(51) Int. Cl.
*H05B 37/00* (2006.01)

(52) U.S. Cl.
USPC ..... 315/219; 315/276; 315/307

(58) Field of Classification Search
USPC ..... 315/307, 308, 224, 219, 276, 279, 277, 315/278
See application file for complete search history.

(56) References Cited

U.S. PATENT DOCUMENTS

| | | | | |
|---|---|---|---|---|
| 6,528,970 | B1 | 3/2003 | Liu et al. | |
| 7,402,957 | B2 | 7/2008 | Shimura et al. | |
| 7,741,790 | B2 * | 6/2010 | Huang et al. | 315/282 |
| 7,786,681 | B2 * | 8/2010 | Inoue et al. | 315/277 |
| 2008/0067949 | A1 | 3/2008 | Cheng et al. | |
| 2008/0067951 | A1 | 3/2008 | Hsu et al. | |

FOREIGN PATENT DOCUMENTS

| | | |
|---|---|---|
| TW | I242318 | 10/2005 |
| TW | 200813947 A | 3/2008 |
| TW | M350942 | 2/2009 |

OTHER PUBLICATIONS

Taiwan Patent Office, "Office Action", Jun. 5, 2013.

* cited by examiner

*Primary Examiner* — David H Vu
(74) *Attorney, Agent, or Firm* — WPAT, PC; Justin King

(57) ABSTRACT

A driving circuit and lighting equipment using the same are provided. The driving circuit includes a first power receiving terminal, a second power receiving terminal and a power conversion unit. The first power receiving terminal receives an alternating current (AC) input signal. The second power receiving terminal is electrically coupled to a predetermined potential. The power conversion unit is electrically coupled to the first and second power receiving terminals for transforming the AC input signal into corresponding two AC output signals of different phases, wherein the two AC output signals are with the same current.

10 Claims, 4 Drawing Sheets

DRIVING CIRCUIT AND LIGHTING EQUIPMENT USING THE SAME

TECHNICAL FIELD

The present disclosure relates to a driving circuit and lighting equipment using the same, and more particularly to a driving circuit driven by power supplies with different phases and lighting equipment using the same.

BACKGROUND

Conventional flat panel displays, such as thin film transistor liquid crystal displays (TFT-LCD), generally use cold negative electrode fluorescent lamps (CCFLs) as their backlights. CCFLs generally have high luminance and uniform brightness.

However, a CCFL needs to use a high-voltage driving circuit electrically connected to both two ends of the CCFL to drive the CCFL to emit light. The high-voltage driving circuit mainly includes an integrated power board (IPB) and a balance board. The IPB provides a high-voltage alternating current (AC) power supply to the balance board, and the balance board converts the high-voltage AC power supply to a group of AC output power supplies with same phases for driving the CCFLs. However, due to effect of characteristics of CCFLs, the method of using the AC output power supplies with the same phases for driving CCFLs results in generating abnormal water ripple images on the displays, and therefore makes users' eyes feel uncomfortable.

A conventional method for overcoming above shortcomings is adding another high-voltage AC power supply, which provides another group of AC output power supplies with phases that are different to (e.g., reverse to) the phases of aforementioned group of AC output power supplies, to the IPB. Both the two high-voltage AC power supplies are provided to the balance board. The balance board converts the two high-voltage AC power supplies to two groups of AC output power supplies, respectively, wherein phases of the two groups of AC output power supplies are different to (e.g., reverse to) each other. Thus, the two groups of AC output power supplies are both used to drive a CCFL to prevent the abnormal water ripple images from being generated. A disadvantage of the conventional method is that adding another high-voltage AC power supply to the IPB causes cost of the high-voltage driving circuit to increase. Therefore, how to overcome the shortcomings of above conventional high-voltage driving circuit, and provide a high-voltage driving circuit that is easy to manufacture, is an object pursued by industry.

SUMMARY

One object of the present invention is to provide a driving circuit that can be used to drive a plurality of lamps.

Another object of the present invention is to provide a lighting equipment using the driving circuit provided by the present invention.

The present invention provides a driving circuit, which comprises a first power receiving terminal, a second power receiving terminal, and a power conversion unit. The first power receiving terminal receives an alternating current (AC) input signal. The second power receiving terminal is electrically coupled to a predetermined potential. The power conversion unit is electrically coupled to the first power receiving terminal and the second power receiving terminal for transforming the AC input signal. The power conversion unit generates a first AC output signal and a second AC output signal using electromagnetic induction caused by the AC input signal, wherein phases of the first AC output signal and the second AC output signal are reverse to each other, and the first AC output signal and the second AC output signal respectively drive different ones of a plurality of lamps. Furthermore, values of current provided by the first AC output signal and the second AC output signal are equal to each other.

The present invention further provides a lighting equipment, which includes a plurality of lamps, a power providing circuit, and a driving circuit as described above. The power providing circuit provides an AC input signal, and the driving circuit is electrically coupled between the lamps and the power providing circuit.

In a first exemplary embodiment of the present invention, the power conversion unit includes a plurality of first side inductors and a plurality of second side inductors. The first side inductors are electrically connected in series and between the first power receiving terminal and the second power receiving terminal. Each of the second side inductors cooperates with one of the first side inductors to generate electromagnetic induction. Positive electrodes of some of the second side inductors correspond to positive electrodes of their corresponding first side inductors, and positive electrodes of the others of the second side inductors correspond to negative electrodes of their corresponding first side inductors.

In a second exemplary embodiment of the present invention, the first side inductors of above power conversion unit are electrically connected in series and between the first power receiving terminal and the second power receiving terminal. Every two of the second side inductors are paired, each pair of the second side inductors include a front inductor and a back inductor, positive electrode of the front inductor and negative electrode of the back inductor respectively drive two of the plurality of lamps, and negative electrode of the front inductor and positive electrode of the back inductor are coupled to the ground.

In a third exemplary embodiment of the present invention, above power conversion unit includes a plurality of first side inductors, a plurality of second side inductors, and a plurality of third side inductors. The plurality of first side inductors are electrically connected in parallel and between the first power receiving terminal and the second power receiving terminal. Each of the second side inductors cooperates with one of the first side inductors to generate electromagnetic induction. Positive electrodes of some of the second side inductors correspond to positive electrodes of their corresponding first side inductors, and positive electrodes of the others of the second side inductors correspond to negative electrodes of their corresponding first side inductors. The plurality of third side inductors are electrically connected in series to form a closed-loop circuit, and each of the third side inductors corresponds to one of the first side inductors that cooperates with one of the second side inductors to generate electromagnetic induction.

The driving circuit and the lighting equipment using the same provided by the present invention only need to receive one group of AC input signals to generate two groups of AC output signals with different phases. Therefore, abnormally displayed water ripple images generated by using AC output signals with equivalent phases to drive a plurality of lamps are avoided.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention uses a driving circuit to convert an alternating current (AC) input signal to a first AC output signal and a second AC signal that has the same current value as the first AC output signal and a phase reverse to a phase of the first AC output signal, and use both the first AC output signal and the second AC output signal to drive lamps of a backlight module of a display. Since two groups of AC output signals with phases reverse to each other for driving CCFL is achieved by only one group of AC input signals, probability of displaying abnormal water ripples is avoided.

Figure 1:
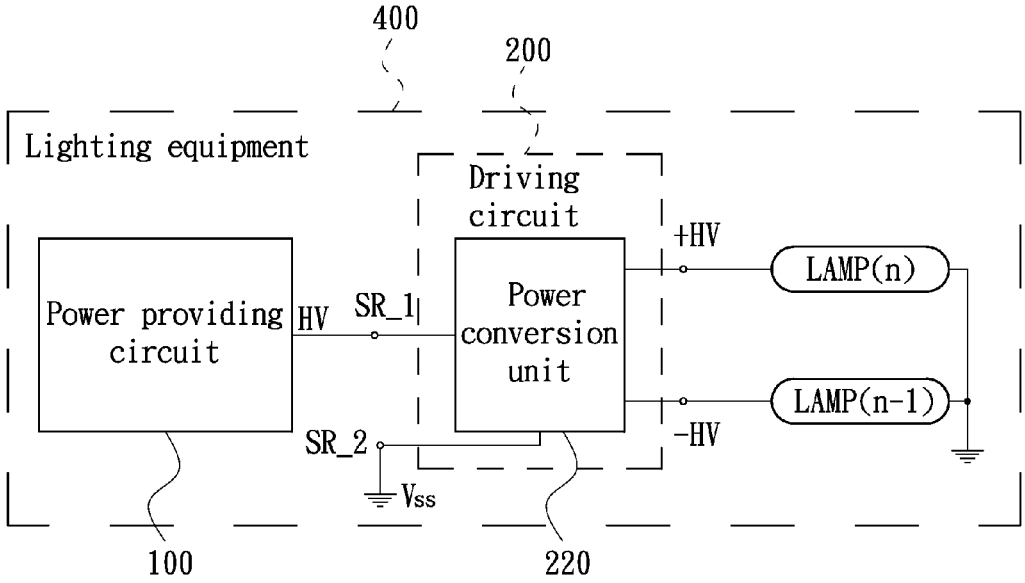
FIG. 1 is a partial block diagram of a lighting equipment, according to a first exemplary embodiment.

Referring to FIG. 1, a partial block diagram of a lighting equipment 400 according to a first exemplary embodiment is shown. The lighting equipment 400 shown in FIG. 1 can be a light resource of a projector, a backlight module of a flat panel display, or other light emitting apparatuses. In this embodiment, the lighting equipment 400 includes an power providing circuit 100, a driving circuit 200, and at least two lamps LAMP(n) and LAMP(n−1). Furthermore, the light equipment 400 can also include more lamps. The power providing circuit 100 includes an AC input signal HV. The driving circuit 200 includes a first power receiving terminal SR_1, a second power receiving terminal SR_2, and a power conversion unit 220. The first power receiving terminal SR_1 receives the AC input signal HV provided by the power providing circuit 100. The second power receiving terminal SR_2 is electrically coupled to a predetermined potential VSS. The predetermined potential VSS can be any electric potential. In this embodiment, the predetermined potential VSS is the ground. The power conversion unit 220 is electrically coupled to both the first power receiving terminal SR_1 and the second power receiving terminal SR_2 for transforming the AC input signal HV into a first AC output signal +HV and a second AC output signal −HV. Phases of the first AC output signal +HV and the second AC output signal −HV are reverse to each other, and the first AC output signal +HV and the second AC output signal −HV respectively drive the lamp LAMP(n) and the lamp LAMP(n−1).

Particularly, the power conversion unit 220 generates the first AC output signal +HV and the second AC output signal −HV using electromagnetic induction caused by the AC input signal HV. Phases of the first AC output signal +HV and the second AC output signal −HV are reverse to each other, and current values of Phases of the first AC output signal +HV and the second AC output signal −HV are equal to each other. The first AC output signal +HV is provided for driving the lamp LAMP(n), and the second AC output signal −HV is provided for driving the lamp LAMP(n−1).

Figure 2A:
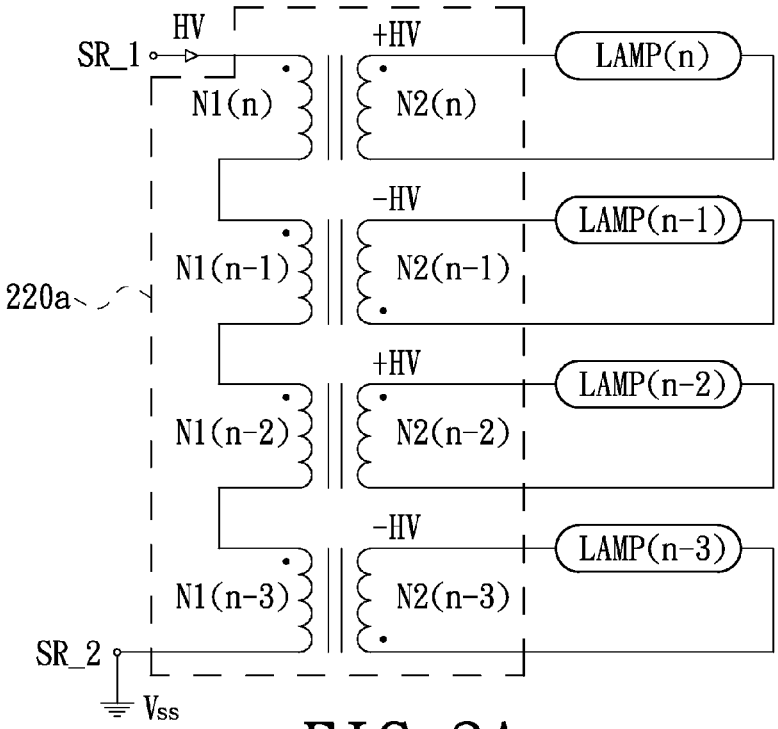
FIG. 2A is a circuit diagram of a power conversion unit of a light equipment, according to a second exemplary embodiment.

Refer to FIG. 2A, which shows a circuit diagram of a power conversion unit 220*a* of a lighting equipment (not labeled) according to a second exemplary embodiment. The lighting equipment according to the second exemplary embodiment differs from the lighting equipment 400 in that the power conversion unit 220*a* replaces the power conversion unit 220, and the lighting equipment according to the second exemplary embodiment comprises more lamps, such as lamps LAMP(n−2) and LAMP(n−3). Particularly, in this embodiment, the power conversion unit 220*a* includes a plurality of first side inductors N1(*n*), N1(*n*−1), N1(*n*−2), and N1(*n*−3), and a plurality of second side inductors N2(*n*), N2(*n*−1), N2(*n*−2), and N2(*n*−3). The first side inductors N1(*n*)~N1(*n*−3) are electrically connected in series between the first power receiving terminal SR_1 and the second power receiving terminal SR_2, and transmit power of the AC input signal HV to the second side inductors N2(*n*)~N2(*n*−3) using electromagnetic couple according to turn ratios of the first side inductors N1(*n*)~N1(*n*−3) to their corresponding second side inductors N2(*n*)~N2(*n*−3). It is noteworthy that positive electrodes (dotted ends) of some of the second side inductors, such as the second side inductors N2(*n*) and N2(*n*−2), are respectively configured to correspond to positive electrodes of their corresponding first side inductors, such as the first side inductors N1(*n*) and N1(*n*−2), and positive electrodes of the others of the second side inductors, such as the second side inductors N2(*n*−1) and N2(*n*−3), are respectively configured to correspond to negative electrodes of their corresponding first side inductors, such as the first side inductors N1(*n*−1) and N1(*n*−3).

In other words, the first side inductors N1(*n*)~N1(*n*−3) receive the AC input signal HV, and transmit power of the received AC input signal HV to the second side inductors N2(*n*)~N2(*n*−3) by means of electromagnetic couple. In the power transmission process, phase of electric power transmitted from the first side inductors N1(*n*) and N1(*n*−2) to the second side inductors N2(*n*) and N2(*n*−2) and used to drive the lamps LAMP(n) and LAMP(n−2) by the second side inductors N2(*n*) and N2(*n*−2) is reverse to phase of electric power transmitted from the first side inductors N1(*n*−1) and N1(*n*−3) to the second side inductors N2(*n*−1) and N2(*n*−3) and used to drive the lamps LAMP(n−1) and LAMP(n−3) by the second side inductors N2(*n*−1) and N2(*n*−3).

Furthermore, since the first side inductors N1(*n*)-N1(*n*−3) are connected in series, current passing through the first side inductors N1(*n*)~N1(*n*−3) is uniform. On this condition, if the turn ratios of the first side inductors N1(*n*)~N1(*n*−3) to their corresponding second side inductors N2(*n*)~N2(*n*−3) are equal to each other, current passing through the second side inductors N2(*n*)~N2(*n*−3) can be uniform. Based on this reason, current passing through the driven lamps LAMP(n) ~LAMP(n−3) is also uniform. If winding turns of the first side inductors N1(*n*)~N1(*n*−3) are further configured to be equal to each other, potential differences between two ends of each of the second side inductors N2(*n*)~N2(*n*−3) can also be equal to each other.

Figure 2B:
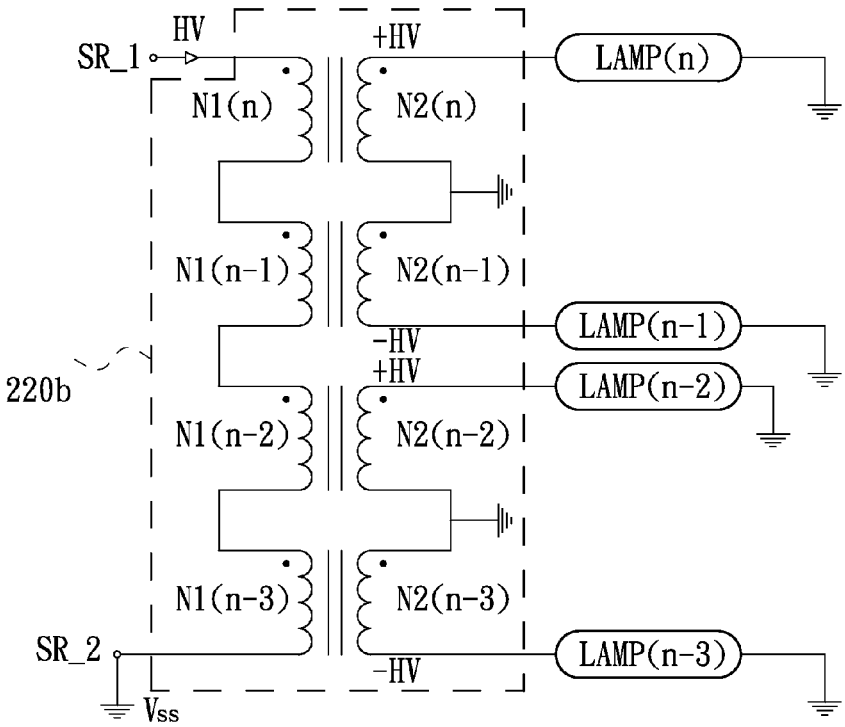
FIG. 2B is a circuit diagram of a power conversion unit of a light equipment, according to a third exemplary embodiment.

Refer to FIG. 2B, which shows a circuit diagram of a power conversion unit 220*b* of a lighting equipment (not labeled) according to a third exemplary embodiment. The lighting equipment according to the third exemplary embodiment differs from the lighting equipment according to the second exemplary embodiment in that the power conversion unit 220*b* replaces the power conversion unit 220*a*. Particularly, in this embodiment, the power conversion unit 220*b* includes a plurality of first side inductors N1(*n*), N1(*n*−1), N1(*n*−2), and N1(*n*−3), and a plurality of second side inductors N2(*n*), N2(*n*−1), N2(*n*−2), and N2(*n*−3). The first side inductors N1(*n*)~N1(*n*−3) are electrically connected in series between the first power receiving terminal SR_1 and the second power receiving terminal SR_2, and transmit power of the AC input signal HV to the second side inductors N2(*n*)~N2(*n*−3) using electromagnetic couple according to turn ratios of the first side inductors N1(*n*)~N1(*n*−3) to their corresponding second side inductors N2(*n*)~N2(*n*−3). As shown in FIG. 2B, since the second side inductors N2(*n*) and N2(*n*−1) are electrically coupled together, the second side inductors N2(*n*) and N2(*n*−1) are regarded as a pair of second side inductors. For the same reason, the second side inductors N2(*n*−2) and N2(*n*−3) electrically coupled together are regarded as another pair of second side inductors. In this embodiment and following other embodiments, in each pair of the second side inductors, one inductor that uses a positive electrode thereof to drive a lamp is referred to as a front inductor, such as the second side inductors N2(*n*) and N2(*n*−2) in this embodiment, and the other inductor that uses a negative electrode thereof to drive a lamp is referred to as a back inductor, such as the second side inductors N2(*n*−1) and N2(*n*−3) of this embodiment.

As shown in FIG. 2B, the positive electrodes of the front inductors are respectively electrically coupled to the lamps LAMP(n) and LAMP(n−2), and the negative electrodes of the back inductors are respectively electrically coupled to the lamps LAMP(n−1) and LAMP(n−3). In each pair of second side inductors, the negative electrode of the front inductor and the positive electrode of the back inductor are both electrically coupled to the ground. Thus, although electromagnetic couple generated between each one of a pair of second side inductors and its corresponding first side inductor has the same polarity as electromagnetic couple generated between the other of the pair of second side inductors and its corresponding first side inductor, the ends of the two second side inductors are reverse to each other. Therefore, the AC output signals +HV and −HV for driving the lamps have reverse phases.

Similar to FIG. 2A, since the first side inductors N1(*n*)~N1(*n*−3) are connected in series, current passing through the first side inductors N1(*n*)~N1(*n*−3) is uniform. On this condition, if the turn ratios of the first side inductors N1(*n*)~N1(*n*−3) to their corresponding second side inductors N2(*n*)~N2(*n*−3) are equal to each other, current passing through the second side inductors N2(*n*)~N2(*n*−3) (i.e., the current driving the lamps LAMP(n)~LAMP(n−3)) can be uniform. Furthermore, since the negative electrodes of the front inductors, the positive electrodes of the back inductors, and one end of each of the driven lamps are all electrically coupled to the same potential (e.g., electrically coupled to the ground in this embodiment), on the premise that the turn ratios of the first side inductors N1(*n*)~N1(*n*−3) to their corresponding second side inductors N2(*n*)~N2(*n*−3) are equal to each other, if winding turns of the first side inductors N1(*n*)~N1(*n*−3) are equal to each other, potential differences between two ends of each of the lamps LAMP(n)~LAMP(n−3) are also equal to each other.

Figure 2C:
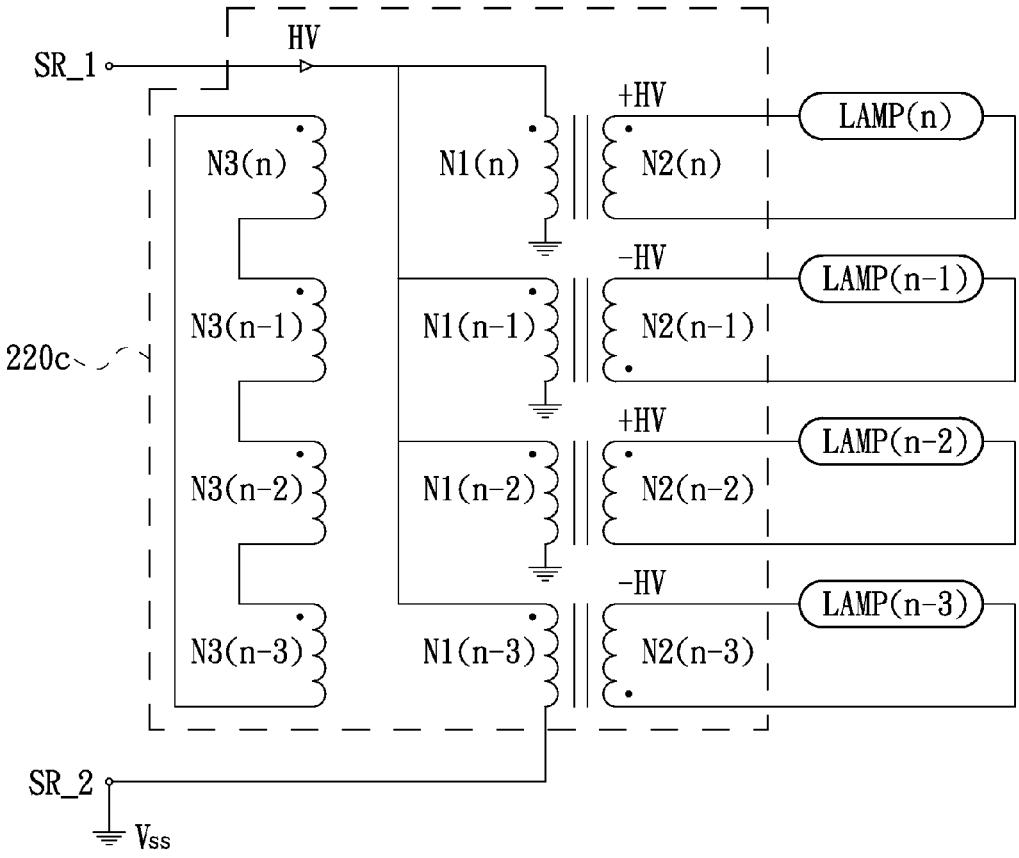
FIG. 2C is a circuit diagram of a power conversion unit of a light equipment, according to a fourth exemplary embodiment.

Refer to FIG. 2C, which shows a circuit diagram of a power conversion unit 220*c* of a lighting equipment (not labeled) according to a fourth exemplary embodiment. The lighting equipment according to the fourth exemplary embodiment differs from the lighting equipment according to the second exemplary embodiment in that the power conversion unit 220*c* replaces the power conversion unit 220*a*. Particularly, in this embodiment, the power conversion unit 220*c* includes a plurality of first side inductors N1(*n*), N1(*n*−1), N1(*n*−2), and N1(*n*−3), a plurality of second side inductors N2(*n*), N2(*n*−1), N2(*n*−2), and N2(*n*−3), and a plurality of third side inductors N3(*n*), N3(*n*−1), N3(*n*−2), and N3(*n*−3). The first side inductors N1(*n*)~N1(*n*−3) are electrically connected in parallel between the first power receiving terminal SR_1 and the second power receiving terminal SR_2. The second side inductors N2(*n*)~N2(*n*−3) respectively drives the lamps LAMP(n), LAMP(n−1), LAMP(n−2), and LAMP(n−3). Relations between the second side inductors N2(*n*)~N2(*n*−3) and the first side inductors N1(*n*)~N1(*n*−3) are similar to that of the embodiment shown in FIG. 2A, and thus are unnecessary to go into details.

It is noteworthy that the third side inductors N3(*n*)~N3(*n*−3) are electrically connected in series, and a positive electrode of the third side inductor N3(*n*) is electrically coupled to a negative electrode of the third side inductor N3(*n*−3), such that the third side inductors N3(*n*)~N3(*n*−3) form a closed-loop circuit. Each of the third side inductors N3(*n*)~N3(*n*−3) corresponds to a second side inductor and a first side inductor electrically coupled with the second side inductor, and the phase of each third side inductor is equivalent to the phase of its corresponding first side inductor. For example, the third side inductor N3(*n*) corresponds to the second side inductor N2(*n*) and the first side inductor N1(*n*), and the positive electrode of the third side inductor N3(*n*) corresponds to the positive electrode of first side inductor N1(*n*), such that phase change of the potential on the positive electrode of the third side inductor N3(*n*) changes is similar to phase change of the potential on the positive electrode of the first side inductor N1(*n*).

Since the third side inductors N3(*n*)~N3(*n*−3) are electrically connected in series to form a closed-loop circuit, therefore, current passing through the third side inductors N3(*n*)~N3(*n*−3) is uniform. Accordingly, for the same reasons as that of the embodiments shown in FIG. 2A or FIG. 2B, the value of the current passing through the second side inductors N2(*n*)~N2(*n*−3) and the potential values of the AC output signals +HV and −HV used to drive the lamps LAMP(n)-LAMP(n−3) can also be configured to be uniform. Furthermore, based upon the same reasons as that of the embodiment shown in FIG. 2A, the phases of the AC output signals +HV and −HV are reverse to each other.

Additionally, a power conversion unit of the present invention does not need to only include similar circuits. That is, if necessary, the circuits shown in FIG. 2A, FIG. 2B, FIG. 2C, and circuits provided by other design methods, can be used in one power conversion unit of the present invention.

Besides above circuit structures, since the AC input signal HV may generate different changes due to differences of the equivalent impedance of a whole driving circuit when it is provided to the first power receiving terminal SR_1 of the driving circuit, a driving circuit can be further provided with an impedance matching circuit, thereby overcoming these shortcomings.

Figure 3:
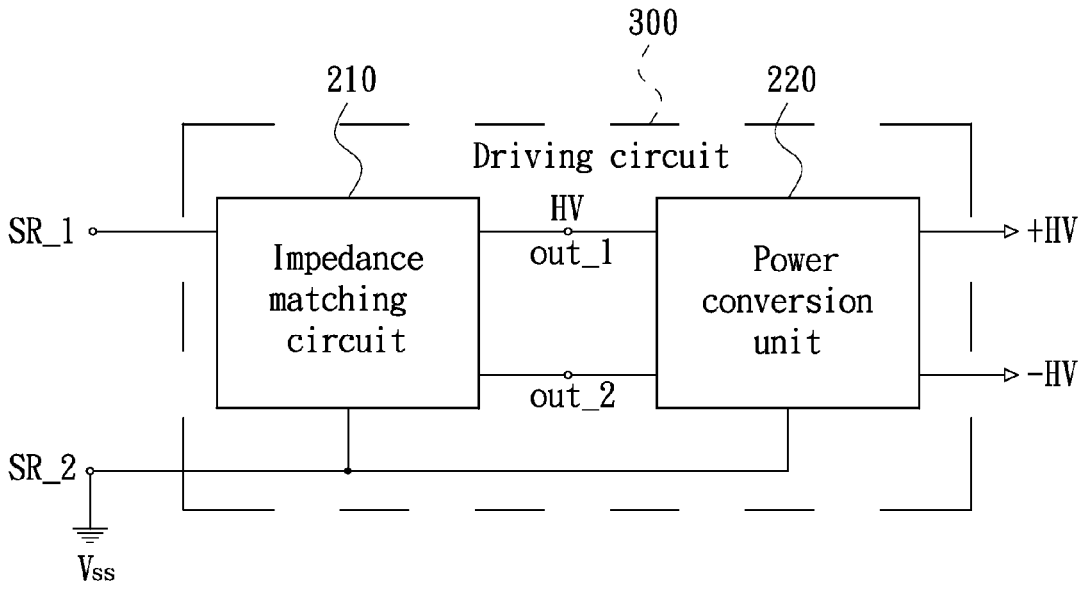
FIG. 3 is a block diagram of a driving circuit of a lightning equipment, according to a fifth exemplary embodiment.

Referring to FIG. 3, which shows a block diagram of a driving circuit 300 of a lighting equipment (not labeled) according to a fifth exemplary embodiment. The lighting equipment according to the fifth exemplary embodiment differs from the lighting equipment 400 in that the driving circuit 300 replaces the driving circuit 200. The driving circuit 300 differs from the driving circuit 200 in that the driving circuit 200 only uses the power conversion unit 220, while the driving circuit 300 uses both the power conversion unit 220 and an impedance matching circuit 210, wherein the impedance matching circuit 210 is electrically coupled between the first power receiving terminal SR_1 and the power conversion unit 220.

The impedance matching circuit 210 has two input terminals, a first power output terminal OUT_1, and a second power output terminal OUT_2. One of the two input terminals is electrically coupled to the first power receiving terminal SR_1 by wires to receive the AC input signal HV, and the other of the two input terminals is electrically coupled to the second power receiving terminal SR_2 by wires to receive a predetermined potential VSS, which is a grounded potential in this embodiment. The impedance matching circuit 210 enables the equivalent impedance behind the first power receiving terminal SR_1 to be matched with the equivalent impedance in front of the first power receiving terminal SR_1, and enable the equivalent impedance behind the second power receiving terminal SR_2 to be matched with the equivalent impedance in front of the second power receiving terminal SR_2. In this way, the first power output terminal OUT_1 of the impedance matching circuit 210 can wholly output the received AC input signal HV, and the second power receiving terminal SR_2 can output the predetermined potential VSS (i.e., the grounded potential, in this embodiment).

Figure 4:
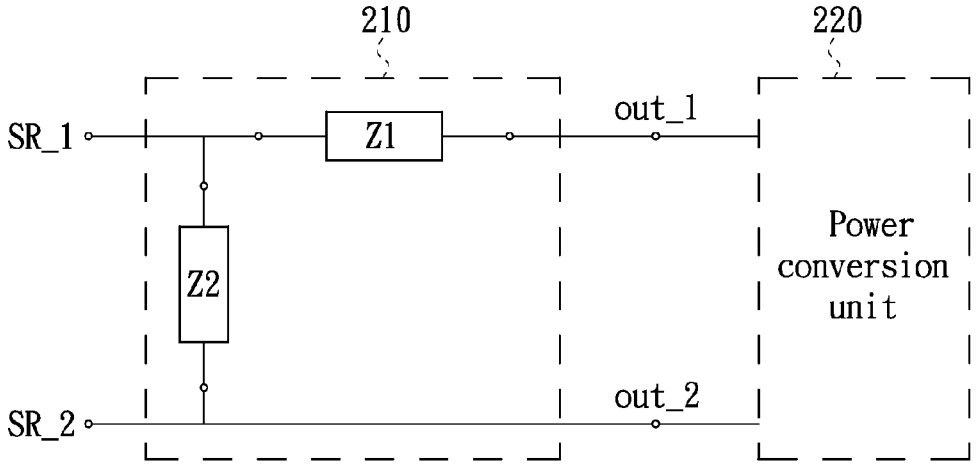
FIG. 4 is a block diagram of an impedance matching circuit of the lightning equipment shown in FIG. 3.

Particularly, referring to FIG. 4, which is a block diagram of the impedance matching circuit 210. The impedance matching circuit 210 includes a first impedance Z1 and a second impedance Z2. The first impedance Z1 includes a first entry end and a second entry end, the first entry end is electrically coupled to the first power receiving terminal SR_1 by wires, and the second entry end is electrically coupled to the first power output terminal OUT_1 by wires. The second impedance Z1 also includes two entry ends, one of the two entry ends is electrically coupled to the first entry end of the first impedance Z1, and the other of the two entry ends is electrically coupled to both the second power receiving terminal SR_2 and the second power output terminal OUT_2. The first impedance Z1 and the second impedance Z2 can be impedance components such as resistors, capacitors, inductors, or combinations thereof for achieving impedance matching, without other special limitations.

In conclusion, after the present invention improves relative technology, the water ripple images caused by conventional methods of using output signals with equivalent phases generated by backlight driving circuits to drive backlights can be effectively decreased. Thus, stabilities of the driving circuits will be easier to maintain, and quality of displaying images can be further improved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A driving circuit for driving a plurality of lamps, comprising:

a first power receiving terminal receiving an alternating current (AC) input signal;

a second power receiving terminal electrically coupled to a predetermined potential; and a power conversion unit electrically coupled to the first power receiving terminal and the second power receiving terminal for transforming the AC input signal, the power conversion unit generating a first AC output signal and a second AC output signal using electromagnetic induction caused by the AC input signal;

wherein the first AC output signal and the second AC output signal are of opposite phase, and the first AC output signal and the second AC output signal respectively drive different ones of the lamps; and wherein values of current provided by the first AC output signal and the second AC output signal are equal.

2. The driving circuit according to claim 1, wherein the power conversion unit comprises:

a plurality of first side inductors electrically connected in series and between the first power receiving terminal and the second power receiving terminal; and a plurality of second side inductors, each of the second side inductors cooperating with one of the first side inductors to generate electromagnetic induction, positive electrodes of some of the second side inductors corresponding to positive electrodes of their corresponding first side inductors, and positive electrodes of the others of the second side inductors corresponding to negative electrodes of their corresponding first side inductors.

3. The driving circuit according to claim 1, wherein the power conversion unit comprises:

a plurality of first side inductors electrically connected in series and between the first power receiving terminal and the second power receiving terminal; and a plurality of paired second side inductors, each pair of the second side inductors including a front inductor and a back inductor, positive electrode of the front inductor and negative electrode of the back inductor respectively driving two of the plurality of lamps, and negative electrode of the front inductor and positive electrode of the back inductor coupled to the ground.

4. The driving circuit according to claim 1, wherein the power conversion unit comprises:

a plurality of first side inductors electrically connected in parallel and between the first power receiving terminal and the second power receiving terminal;

a plurality of second side inductors, each of the second side inductors cooperating with one of the first side inductors to generate electromagnetic induction; positive electrodes of some of the second side inductors corresponding to positive electrodes of their corresponding first side inductors, and positive electrodes of the others of the second side inductors corresponding to negative electrodes of their corresponding first side inductors; and a plurality of third side inductors electrically connected in series to form a closed-loop circuit, each of the third side inductors corresponding to one of the first side inductors that cooperates with one of the second side inductors to generate electromagnetic induction.

5. The driving circuit according to claim 1, further comprising:

an impedance matching circuit electrically coupled between the first power receiving terminal and the power conversion unit for equalizing the impedances of two sides of the first power receiving terminal.

6. A lighting equipment, comprising:

a plurality of lamps;

a power providing circuit providing an alternating current (AC) input signal; and a driving circuit, comprising:

a first power receiving terminal receiving the AC input signal;

a second power receiving terminal electrically coupled to a predetermined potential; and a power conversion unit electrically coupled to the first power receiving terminal and the second power receiving terminal for transforming the AC input signal, the power conversion unit generating a first AC output signal and a second AC output signal using electromagnetic induction caused by the AC input signal;

wherein phases of the first AC output signal and the second AC output signal are reverse to each other, and the first AC output signal and the second AC output signal respectively drive different ones of the lamps; and wherein values of current provided by the first AC output signal and the second AC output signal are equal.

7. The lighting equipment according to claim 6, wherein the power conversion unit comprises:

a plurality of first side inductors electrically connected in series and between the first power receiving terminal and the second power receiving terminal; and a plurality of second side inductors, each of the second side inductors cooperating with one of the first side inductors to generate electromagnetic induction; positive electrodes of some of the second side inductors corresponding to positive electrodes of their corresponding first side inductors, and positive electrodes of the others of the second side inductors corresponding to negative electrodes of their corresponding first side inductors.

8. The lighting equipment according to claim 6, wherein the power conversion unit comprises:

a plurality of first side inductors electrically connected in series and between the first power receiving terminal and the second power receiving terminal; and a plurality of second side inductors, every two of the second side inductors being paired; each pair of the second side inductors including a front inductor and a back inductor, positive electrode of the front inductor and negative electrode of the back inductor respectively driving two of the plurality of lamps, and negative electrode of the front inductor and positive electrode of the back inductor coupled to the ground.

9. The lighting equipment according to claim 6, wherein the power conversion unit comprises:

a plurality of first side inductors electrically connected in parallel and between the first power receiving terminal and the second power receiving terminal;

a plurality of second side inductors, each of the second side inductors cooperating with one of the first side inductors to generate electromagnetic induction; positive electrodes of some of the second side inductors corresponding to positive electrodes of their corresponding first side inductors, and positive electrodes of the others of the second side inductors corresponding to negative electrodes of their corresponding first side inductors; and a plurality of third side inductors electrically connected in series to form a closed-loop circuit, each of the third side inductors corresponding to one of the first side inductors that cooperates with one of the second side inductors to generate electromagnetic induction.

10. The lighting equipment according to claim 6, further comprising:

an impedance matching circuit electrically coupled between the first power receiving terminal and the power conversion unit, the impedance matching circuit making impedances of two sides of the first power receiving terminal equal.

* * * * *